US006752651B2

(12) United States Patent
Wang et al.

(10) Patent No.: US 6,752,651 B2
(45) Date of Patent: Jun. 22, 2004

(54) BUS CABLE CONNECTOR HAVING BENT SOLDERING PINS SOLDERED TO WIRE CONDUCTORS

(75) Inventors: Pai-Chuan Wang, Taipei (TW); Yau-Hsuan Liu, Taipei Hsien (TW)

(73) Assignee: Hung-Jen Chiu

( * ) Notice: Subject to any disclaimer, the term of this patent is extended or adjusted under 35 U.S.C. 154(b) by 0 days.

(21) Appl. No.: 10/418,154

(22) Filed: Apr. 18, 2003

(65) Prior Publication Data

US 2003/0181095 A1 Sep. 25, 2003

Related U.S. Application Data

(63) Continuation-in-part of application No. 09/991,677, filed on Nov. 26, 2001, now abandoned.

(30) Foreign Application Priority Data

Sep. 12, 2001 (TW) ..... 90215659 U

(51) Int. Cl.[7] ..... H01R 12/24
(52) U.S. Cl. ..... 439/492
(58) Field of Search ..... 439/492, 874, 439/499, 67, 77

(56) References Cited

U.S. PATENT DOCUMENTS 6,247,977 B1 * 6/2001 Tanaka et al. ..... 439/874
2002/0173191 A1 * 11/2002 I-Tse ..... 439/329

FOREIGN PATENT DOCUMENTS

EP 000602539 A2 * 9/1993 ..... H01R/9/07

* cited by examiner

*Primary Examiner*—Jean F. Duverne
(74) *Attorney, Agent, or Firm*—Lowe Hauptman Gilman & Berner, LLP

(57) ABSTRACT

A cable connector includes an insulative body having a plurality of spaced apart parallel grooves formed in one face thereof, and a plurality of terminals which extend through the insulative body and include soldering pins extending out of the insulative body through the face on two sides of the parallel grooves. The soldering pins are bent to be received respectively within the grooves. The insulative body is mounted within a connector housing. Wires of a bus cable are stripped and received in the respective grooves over the soldering pins for solder connection with the soldering pins. The connector provides reliable connection between terminals and wires, reduces the height of the connector, and lower production costs.

7 Claims, 7 Drawing Sheets

BUS CABLE CONNECTOR HAVING BENT SOLDERING PINS SOLDERED TO WIRE CONDUCTORS

CROSS-REFERENCE TO RELATED APPLICATION

This application is also a continuation-in-part of U.S. patent application Ser. No. 09/991,677 filed by the applicant on Nov. 26, 2001, now abandoned the entire disclosure of which is incorporated herein by reference.

This application claims priority of Taiwanese Application No. 090215659 filed on Sep. 12, 2001.

BACKGROUND OF THE INVENTION

1. Field of the Invention

This invention relates to an electrical connector, more particularly to an SCSI (small computer systems interface) bus cable connector having bent soldering pins soldered to the wires of a bus cable.

2. Description of the Related Art

With the fast development of the information industry, use of a large amount of storage devices is becoming popular. The transmission and communication of data in the hardware requires use of SCSI bus cable connectors. In this era of high speed transmission, commonly used cable connectors are configured as a piercing type which includes an insulating housing with a plurality of spaced-apart insert holes provided for retaining signal terminals. The signal terminals are respectively provided with fork-like clamping ends used to clamp and pierce respective signal wires. The connection of the signal wires with the signal terminals is similar to that in a household telephone connection in which the plastic skin in the wire end of each signal wire need not be stripped off, and in which the insulative plastic skin of the signal wire is directly pierced by the clamping end of the respective terminal to permit contact between the terminal and the conductor of the signal wire. Since the signal wires of the bus cable connector are clamped in a piercing manner, each wire conductor is in point contact with the respective signal terminal. Moreover, since only the clamping points on two sides of each wire conductor serve for electrical contact, the stability of signal transmission thereof is more or less unreliable.

U.S. Pat. No. 6,447,329B1 discloses a connector having a connector housing which is provided, at one end face thereof, with a plurality of parallel grooves to receive and align bent soldering sections of signal terminals. Wire conductors of a bus cable are placed within the respective grooves and are soldered to the respective signal terminals received in the grooves. This connector eliminates the use of the piercing type signal terminals. However, since the wire conductors are soldered to the signal terminals directly at the end face of the connector housing, the entire body of the connector housing has to be fabricated from a special high heat-resisting plastic material that can endure the heat generated during the soldering process, thereby increasing costs for producing the connector. On the other hand, the aforesaid U.S. patent was filed later than the priority date of the basic application (U.S. patent application Ser. No. No. 09/991, 677) of this application.

SUMMARY OF THE INVENTION

An object of the present invention is to provide a cable connector in which signal terminals are provided with bent soldering pins for soldering connection with wire conductors, thus eliminating the need to use piercing and clamping ends to pierce the signal terminals.

Another object of the present invention is to provide a cable connector including signal terminals with bent and laid down soldering pins for soldering connection with wire conductors, thus lowering the height of the connector.

Still another object of the present invention is to provide a cable connector in which terminals having solder pins are mounted on an insulative body which is a separate piece from a connector housing, thus permitting the connector housing to be produced from a material which has less heat resistance and inexpensive.

Accordingly, a cable connector in the present invention comprises: an insulative body including two opposite first and second faces, and a plurality of spaced apart parallel grooves formed in the first face; a plurality of terminals extending through the insulative body and including contact portions extending out of the insulative body through the second face, and soldering pins extending out of the insulative body through the first face on two sides of the parallel grooves, the soldering pins being bent to be received respectively within the grooves; a a connector housing for receiving the insulative body; and a plurality of wires including end portions which are stripped and are respectively received within the grooves over the soldering pins for electrical connection with the soldering pins.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
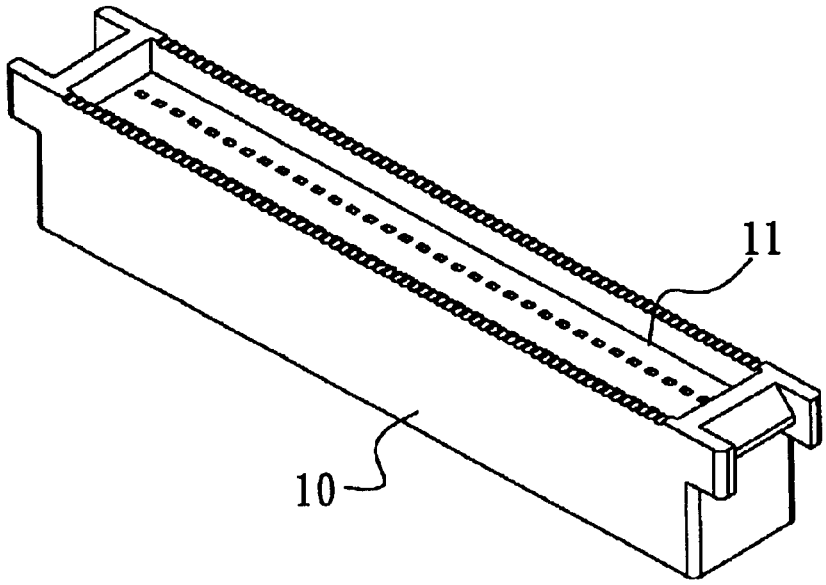
FIG. 1 is a perspective view of a connector housing of a preferred embodiment of the present invention.
Figure 2:
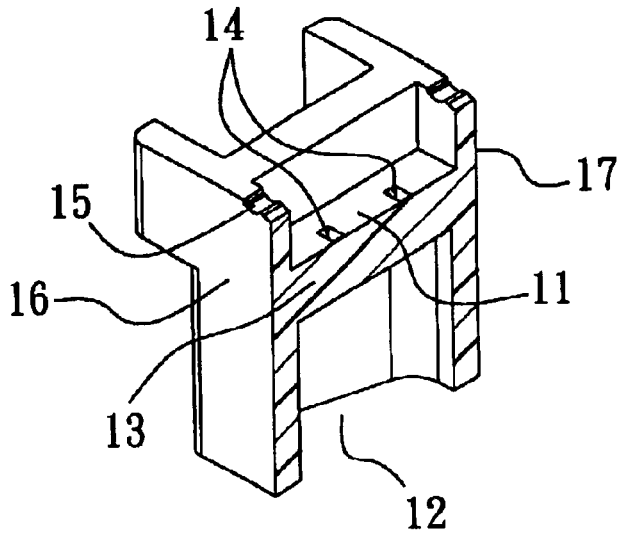
FIG. 2 is a fragmentary enlarged view of the connector housing of FIG. 1.
Figure 3:
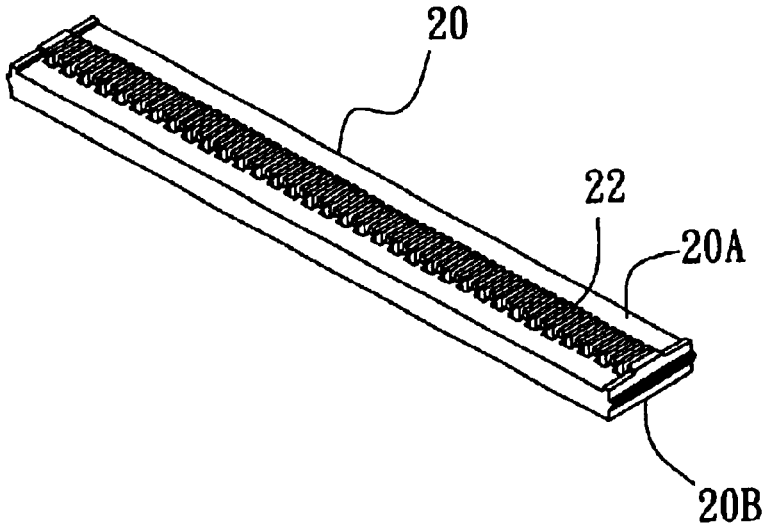
FIG. 3 is a perspective view of an insulative body of a preferred embodiment of the present invention.
Figure 4:
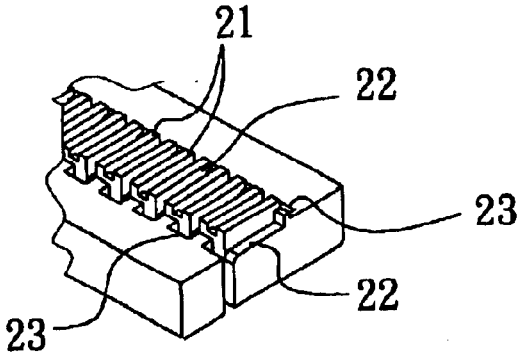
FIG. 4 is a fragmentary enlarged view of the insulative body of FIG. 3.

Referring to FIGS. 1 to 4, a preferred embodiment of an SCSI bus cable connector according to the present invention is shown to include an elongated connector housing 10 having two receiving spaces 11 and 12 which are partitioned by an intermediate wall 13 formed within the connector housing 10 and which open respectively at two opposed ends of the connector housing 10. The intermediate wall 13 is formed with two rows of insert holes 14. A plate-like insulative body 20 has opposed faces 20A and 20B, and the face 20A is formed with a plurality of parallel grooves 22 defined between ribs 21. Two rows of through holes 23 are formed in the insulative body 20 on two sides of the grooves 22. A plurality of curved recesses 15 are formed in the edge faces of two opposed walls 16 and 17 of the connector housing 10.

Figure 5:
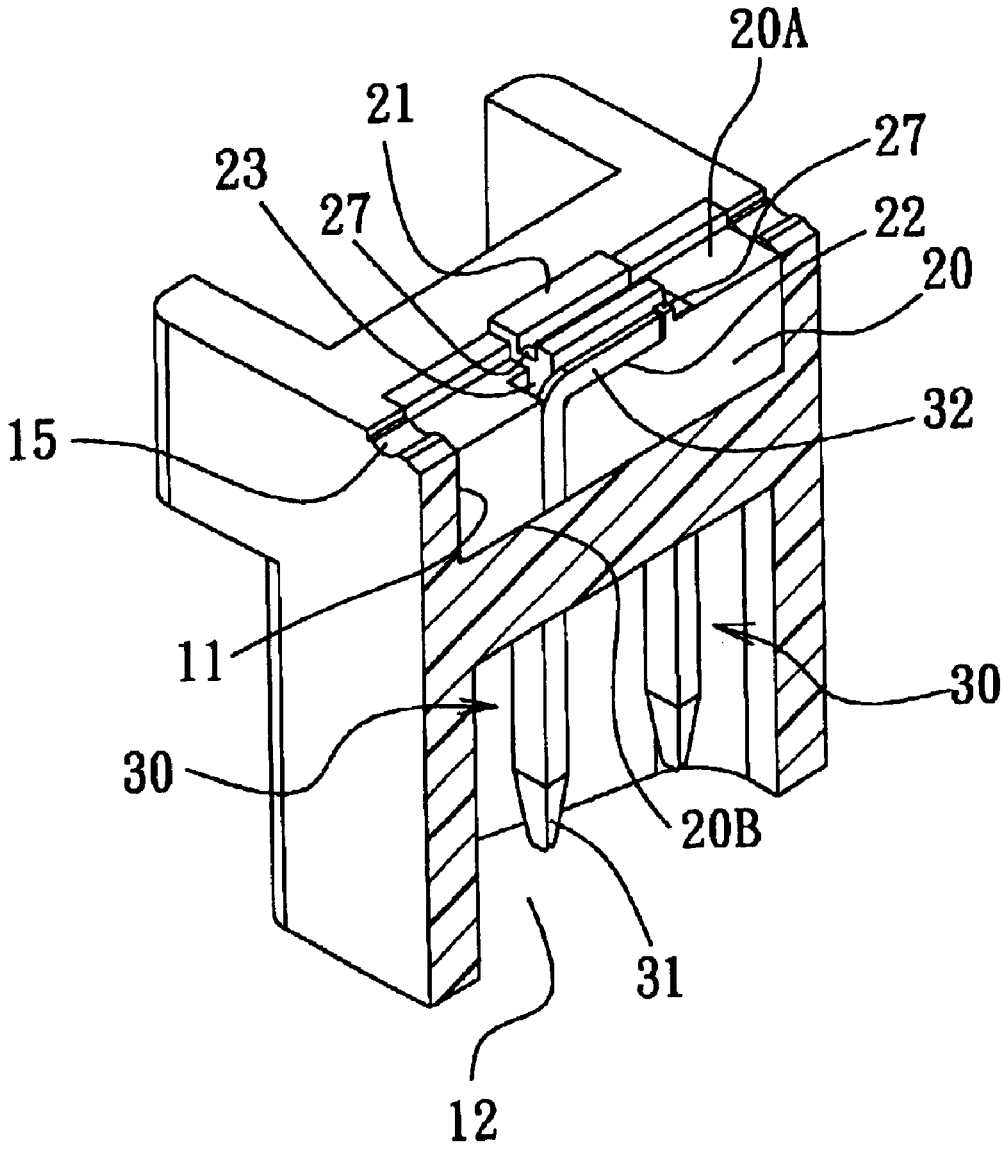
FIG. 5 is a fragmentary enlarged view of the assembly of the connector housing and the insulative body.

Referring to FIG. 5, two rows of terminals 30 are mounted on the insulative body 20 by extending through the respective through holes 23. Each terminal 30 has a contact portion 31 extending out of the insulative body 20 through the face 20B, and a soldering pin 32 extending out of the insulative body 20 through the face 20A. The grooves 22 are disposed between two rows of the soldering pins 32. The soldering pins 32 in two rows are alternately received in the grooves 22. Each groove 22 is formed with a protrusion 27 to stop the end of the corresponding soldering pin 32 and to prevent the soldering material from entering the through hole 23.

The soldering pins 32 of the terminals 30 at two sides of the grooves 22 are bent and laid down to be received within the respective grooves 22. In assembly of the insulative body 20 with the connector housing 10, the insulative body 20 with the terminals 30 is received fittingly in the receiving space 11 of the connector housing 10, and the contact portions 31 of the terminals 30 are inserted through the respective insert holes 14 of the connector housing 10 to extend into the receiving space 12.

Figure 6:
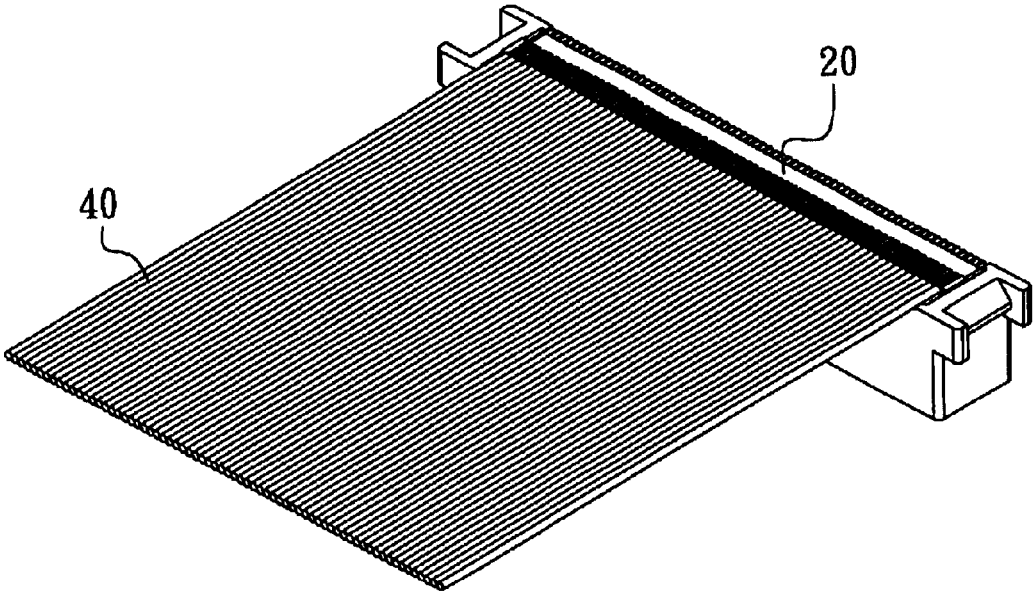
FIG. 6 is a perspective view of the assembly of the preferred embodiment with a cover thereof being removed.
Figure 7:
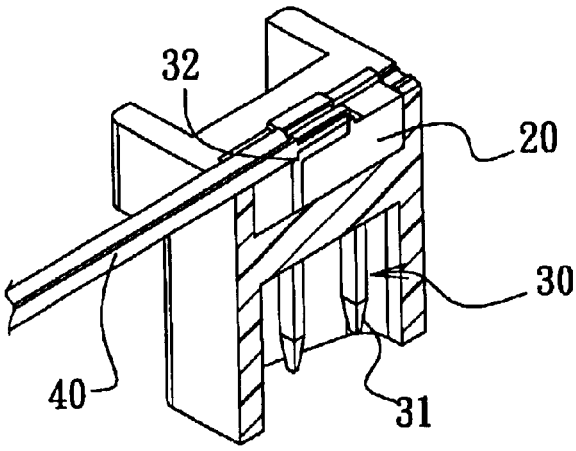
FIG. 7 is a fragmentary enlarged view of the embodiment of FIG. 6.
Figure 8:
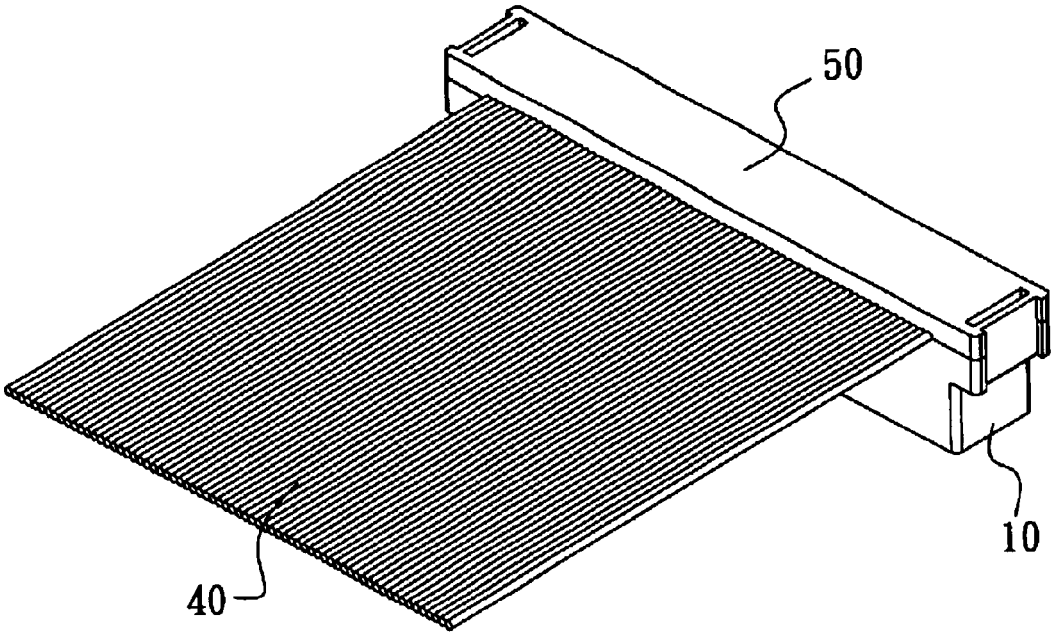
FIG. 8 is the same view as FIG. 6 but with the cover being attached thereto.
Figure 9:
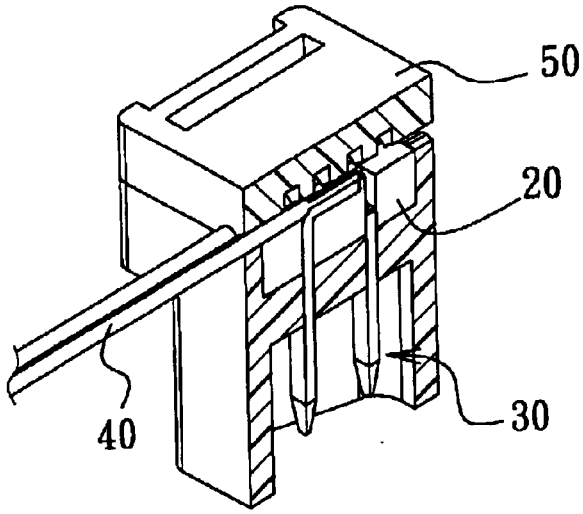
FIG. 9 is a fragmentary enlarged view of the embodiment of FIG. 8.
Figure 10:
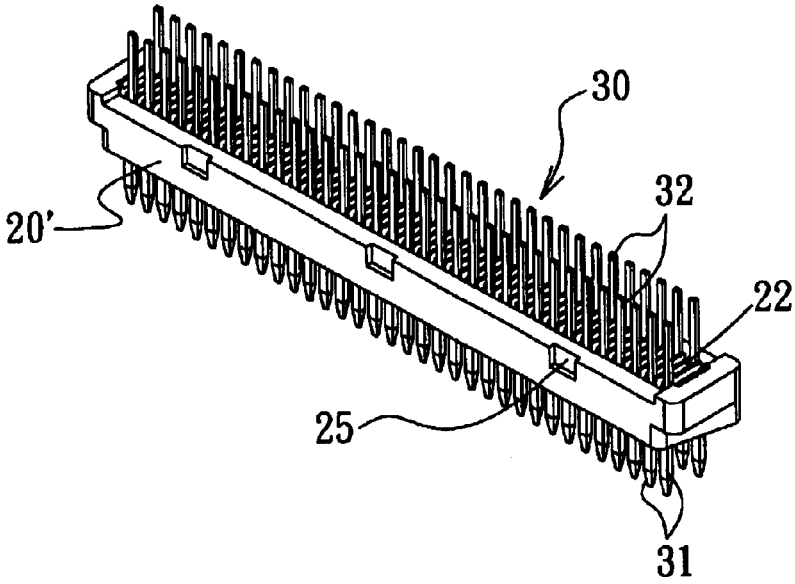
FIG. 10 is a perspective view showing an insulative body insert-molded over a set of terminals for use in another embodiment of the present invention.
Figure 11:
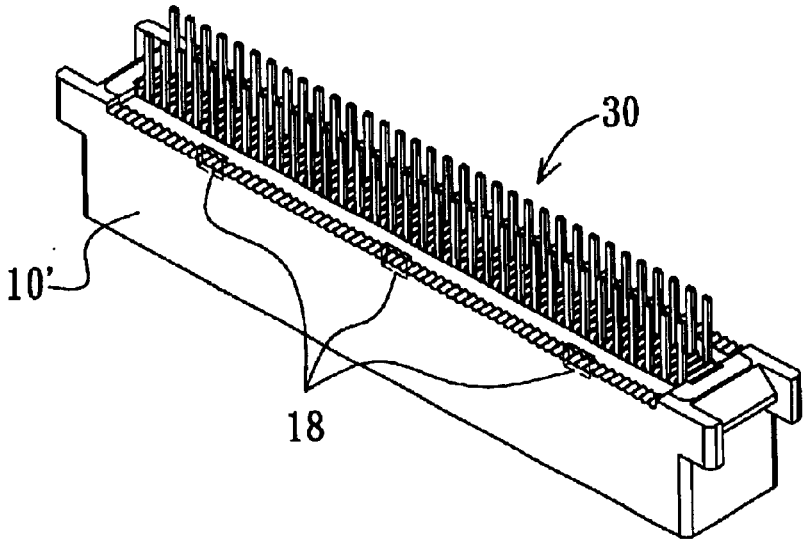
FIG. 11 is a perspective view of the insulative body of FIG. 10 assembled in a connector housing.
Figure 12:
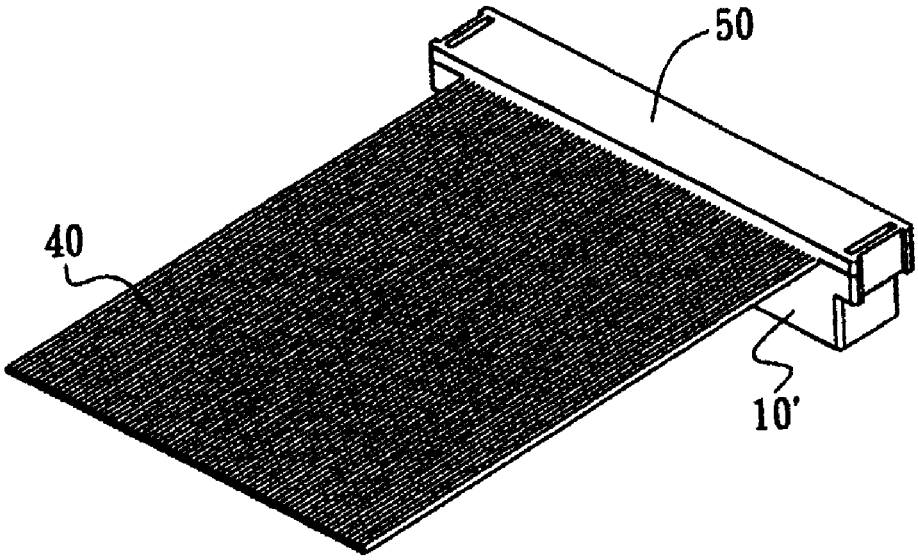
FIG. 12 is a perspective view of another preferred embodiment of the present invention including the insulative body and the connector housing shown in FIG. 11.

Referring to FIGS. 6 and 7, a plurality of wires 40 of a bus cable are aligned with the soldering pins 32 of the terminals 30 by receiving the wires 40 in the respective recesses 15 and the respective grooves 22. End portions of the wires 40 are stripped to expose the core conductors (not shown) thereof, and the exposed core conductors are soldered to the respective soldering pins 32 in a conventional manner. Finally, a cover 50 is placed on the connector housing 10 above the wires 40 to protect the connection between the conductors of the wires 40 and the soldering pins 32 of the terminals 30 as shown in FIGS. 8 and 9.

Figure 13:
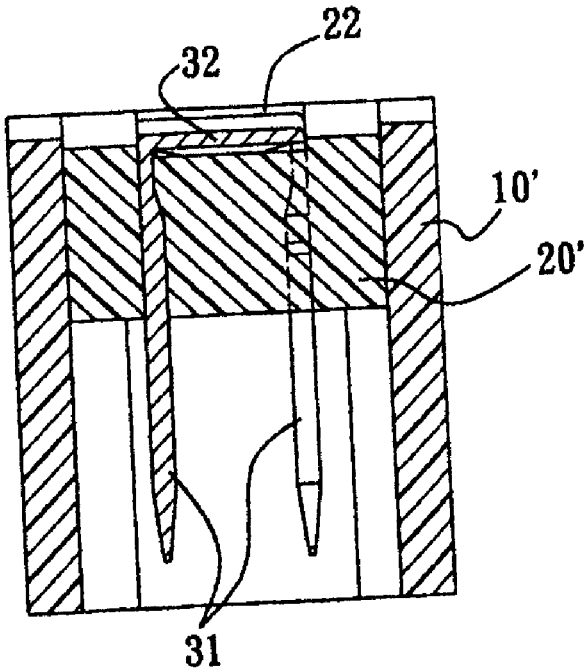
FIG. 13 is a sectional view of the preferred embodiment of FIG. 12.

FIGS. 10 to 13 show another preferred embodiment of the present invention in which elements similar to those shown in the previous embodiment are represented by like reference numerals. This embodiment includes a connector housing 10' and an insulative body 20' holding a plurality of terminals 30. This embodiment differs from the previous embodiment in that the insulative body 20' is molded over the terminals 30 between the contact portions 31 and the soldering pins 32 through an insert molding process. Like the insulative body 20 of the previous embodiment, the insulative body 20' is formed with a plurality of grooves 22 between two rows of the soldering pins 32. However, the protrusions 27 of the insulative body 20 are not formed in the grooves 22 of the insulative body 20', and the insulative body 20' additionally includes recesses 25 on two opposed sides thereof. When the insulative body 20' is mounted inside the connector housing 10', the recesses 25 are engaged respectively with protrusions 18 formed on inner wall surfaces of the connector housing 10'. As best shown in FIG. 13, the soldering pins 32 of the terminals 30 are bent at right angle and are received in the respective grooves 22. The soldering pins 32 in two rows are alternately received in the grooves 22 of the insulative body 20'.

As mentioned above, in both of the preferred embodiments of the present invention, the soldering pins 32 of the terminals 30 are bent and received in the respective grooves 22 and soldered to the respective conductors of the wires 40. Since the soldering pins 32 of the terminals 30 do not protrude upward from the end face of the connector housing 10 or 10', the height of the connector according to the present invention is reduced as compared to the conventional piercing type connectors. In addition, the stability of the electrical connection between the wires 40 and the soldering pins 32 is improved due to an increased in their contact surface area, as compared to the conventional piercing-type connectors in which wires are connected to the respective terminals through a point-to-point contact mode. Moreover, since the terminals 30 are held by the insulative body 20 or 20' which is a separate body from the connector housing 10 or 10', the insulative body 20, 20' can be molded from a material different from that used for forming the connector housing 10 or 10'. In the above-described preferred embodiments, the insulative bodies 20, 20' are made from a high heat-resistant insulation material to endure heat generated during the soldering of the soldering pins 32, whereas the connector housings 10, 10' are made of an inexpensive low heat-resistant insulating material.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A cable connector comprising:

an insulative body including two opposite first and second faces, and a plurality of spaced apart parallel grooves formed in said first face;

a plurality of terminals extending through said insulative body and including contact portions extending out of said insulative body through said first face, and soldering pins extending out of said insulative body through said second face on two sides of said parallel grooves, said soldering pins being bent to be received respectively within said grooves;

a connector housing for receiving said insulative body; and a plurality of wires including end portions which are stripped and are respectively received within said grooves over said soldering pins for electrical connection with said soldering pins.

2. The cable connector as claimed in claim 1, wherein said connector housing has an intermediate wall which divides said connector housing into two receiving spaces, said receiving spaces opening at two opposed ends of said connector housing, said insulative body being fitted within one of said receiving spaces and having through holes for passage of said terminals, said intermediate wall having insert holes aligned with said through holes of said insulative body for insertion of said terminals.

3. The cable connector as claimed in claim 1, further comprises a cover disposed on said connector housing over said wires and said soldering pins.

4. The cable connector as claimed in claim 1, wherein said insulative body is molded over said terminals between said contact portions and said soldering pins through an insert molding process.

5. The cable connector as claimed in claim 4, further comprising interengagement means between said insulative body and said connector housing.

6. The cable connector as claimed in claim 1, wherein said connector housing and said insulative body are made of different insulating materials, said material of said connector housing having a heat-resisting property lower than that of said material of said insulative body.

7. The cable connector as claimed in claim 1, wherein said terminals are arranged in two rows, said grooves being disposed between said soldering pins of two rows of said terminals, said soldering pins of said two rows being alternately received in said grooves.

* * * * *